United States Patent [19]

Ackerly

[11] Patent Number: 4,843,854

[45] Date of Patent: Jul. 4, 1989

[54] ROLLING MILL ROLL ECCENTRICITY CONTROL

[75] Inventor: Robert E. Ackerly, Spokane, Wash.

[73] Assignee: Kaiser Aluminum & Chemical Corporation, Oakland, Calif.

[21] Appl. No.: 106,675

[22] Filed: Oct. 13, 1987

[51] Int. Cl.[4] ..... B21B 37/08

[52] U.S. Cl. ..... 72/8; 72/11; 72/20; 72/21; 72/241; 72/243; 72/245

[58] Field of Search ..... 72/241, 247, 243, 245, 72/20, 8-12, 21

[56] References Cited

U.S. PATENT DOCUMENTS

| | | | |
|---|---|---|---|
| 3,626,739 | 12/1971 | Willeke et al. | 72/241 |
| 3,973,425 | 8/1976 | Woodrow | 72/247 |
| 4,191,042 | 3/1980 | Salter Jr. | 72/247 |
| 4,589,269 | 5/1986 | Michaux | 72/247 |

FOREIGN PATENT DOCUMENTS

| | | | |
|---|---|---|---|
| 1488213 | 7/1967 | France | 72/241 |

*Primary Examiner*—Lowell A. Larson
*Assistant Examiner*—Steven B. Katz
*Attorney, Agent, or Firm*—A. E. Barlay

[57] ABSTRACT

The invention relates to the control of rolling mill backup roll eccentricity by combining the load carrying characteristics of rolling mill tapered roller bearing assemblies during rolling with prescribed levels of axial thrust to effect a controlled deflection of backup roll necks on a 4-high rolling mill or the like due to the selected thrust force applied axially to the ends or necks of the backup rolls. One reason for this is to effect a compensation in the eccentricity of the backup rolls due to roll grinding.

10 Claims, 5 Drawing Sheets

ROLLING MILL ROLL ECCENTRICITY CONTROL

BACKGROUND OF THE INVENTION

This invention relates to devices and systems for controlling backup roll eccentricity and/or strip steering in rolling mill equipment for metals while using tapered roller bearings for the roll mountings. When rolling metal, the deformation force, i.e., the force required to reduce the thickness of the metal, is transmitted to the material through the mill housing, bearing chocks, bearings, roll necks and rolls, to the roll surfaces and into the metal strip. This means that all parts of the mill are stressed by the rolling load and all parts of the mill have a tendency to deform elastically. When the rolling load is applied, all the slack in the bearings, bearing chocks, screwdowns, and hydraulic cylinders is taken up. As the loading continues, the roller bearings have a tendency to deform and the rolls to flatten at the point of contact. Furthermore, the heat in the roll bites generates thermal crowns in the work and the backup rolls, and in addition to controlled coolant application to alleviate this deleterious crowning, a positive or convex mechanical camber is normally ground into the work roll to compensate for the same. During manufacture and subsequent grinding of the backup roll, however, backup roll eccentricity can occur. This eccentricity is the deviation of the axis of rotation at the barrel or main body portion of the roll relative to the axis of rotation of the same roll at its neck supports and is inherent in the manner and amount of precision with which the backup rolls are ground as well as the precision of the bearing components and their mountings.

Unless the aforesaid eccentricity is corrected, it will cause the work rolls to cyclically print out a gauge deviation pattern on the metal material being rolled. Various schemes and procedures have been suggested in the past for correcting this eccentricity problem, such as the complex-electronic measurement systems for detecting mill housing stretch or compression, due to changes in force at which the mill rolls engage the material being rolled, and using such measurements to control a roll actuating mechanism, such as hydraulic cylinders in the mill stands, to control the working space or gap of the mill work rolls. Examples of such systems are illustrated in the King et al U.S. Pat. No. 4,222,254 and Puda U.S. Pat. No. 4,531,392. These systems, however, are not truly precise in correcting the problem they attempt to solve, since they rely upon mathematical estimates of the eccentricity to be corrected because the actual eccentricity of the rolls does not appear to be readily observable. An attempt to overcome the deficiencies of the King et al control system and that of Puda is set forth in the Stewart et al U.S. Pat. No. 4,656,854, which is directed to use of an electronic system that continuously measures the tension of the rolled material entering or exiting a mill to indicate directly cyclic thickness changes in the material due to roll eccentricity and then using these measurements to control the roll actuators, such as hydraulic cylinders and, in turn, the working gap of the work rolls. None of the above eccentricity correcting systems, however, provides for a simple and completely satisfactory operation of the roll actuators per se, regardless of the efficiency of the remaining parts of the system. Proper operation of the actuators per se is critical to the successful operation of the eccentricity correcting system.

In addition to the above systems, various devices have been used in the past to bend backup or work rolls in order to improve flatness of the product being rolled, such as the roll bending devices of U.S. Pat. Nos. 3,442,109, 4,162,627, and 3,902,345. Other devices have used the concepts of laterally or axially shifting the work and backup rolls relative to each other, as illustrated in U.S. Pat. No. 3,943,742, or applying an axial thrust to the ends of the rolls to correct lateral shifting and/or thrust overloading of the rolls due to the stresses, such as thermal stresses, built up in the rolls during rolling, such as is illustrated in U.S. Pat. Nos. 3,973,425, 4,191,042, and 4,589,269.

None of the prror art devices or systems as represented by the aforesaid patents, however, has utilized the concept of applying separate and independent thrust forces to the various ends of the backup rolls and through the medium of tapered roller bearings for the said rolls in the unique fashion of the instant development in order to selectively and precisely change the rolling contour of the backup rolls and thereby compensate for backup roll eccentricity and the deleterious results that flow therefrom.

BRIEF SUMMARY OF THE INVENTION

The instant invention is concerned with controlling backup roll eccentricity by combining the load carrying characteristics of tapered roller bearing assemblies during rolling with prescribed levels of axial thrust to effect controlled deflection of the backup roll on a 4-high mill or the like due to the selected thrust force applied axially to the ends or necks of the backup rolls. By applying a controlled level of thrust to the tapered roller bearings, the line of action of the radial rolling load can be altered. A relatively precise controlled bending of the backup roll necks can thus be effected while exerting relatively small thrust forces on the roll necks axially. The change in backup roll neck deflection provides the corrective radial deflection to the main bodies or barrel portions of the rolls. Further, while the description of the invention will be focused primarily on the use of thrust forces axially applied in conjunction with tapered roller bearing assemblies to control backup roll eccentricity, the same basic mechanisms can be used to influence the path of the strip as to its lateral movements during rolling, such as by introducing sideset, i.e., making the roll gap different across the width of the metal being processed by introducing a larger reference gap on one end or edge as compared to the other. In this instance, the strip will track toward the side of the rolls where the largest gap occurs.

DETAILED DESCRIPTION OF THE PREFERRED EMBODIMENTS OF THE INVENTION

Figure 1:
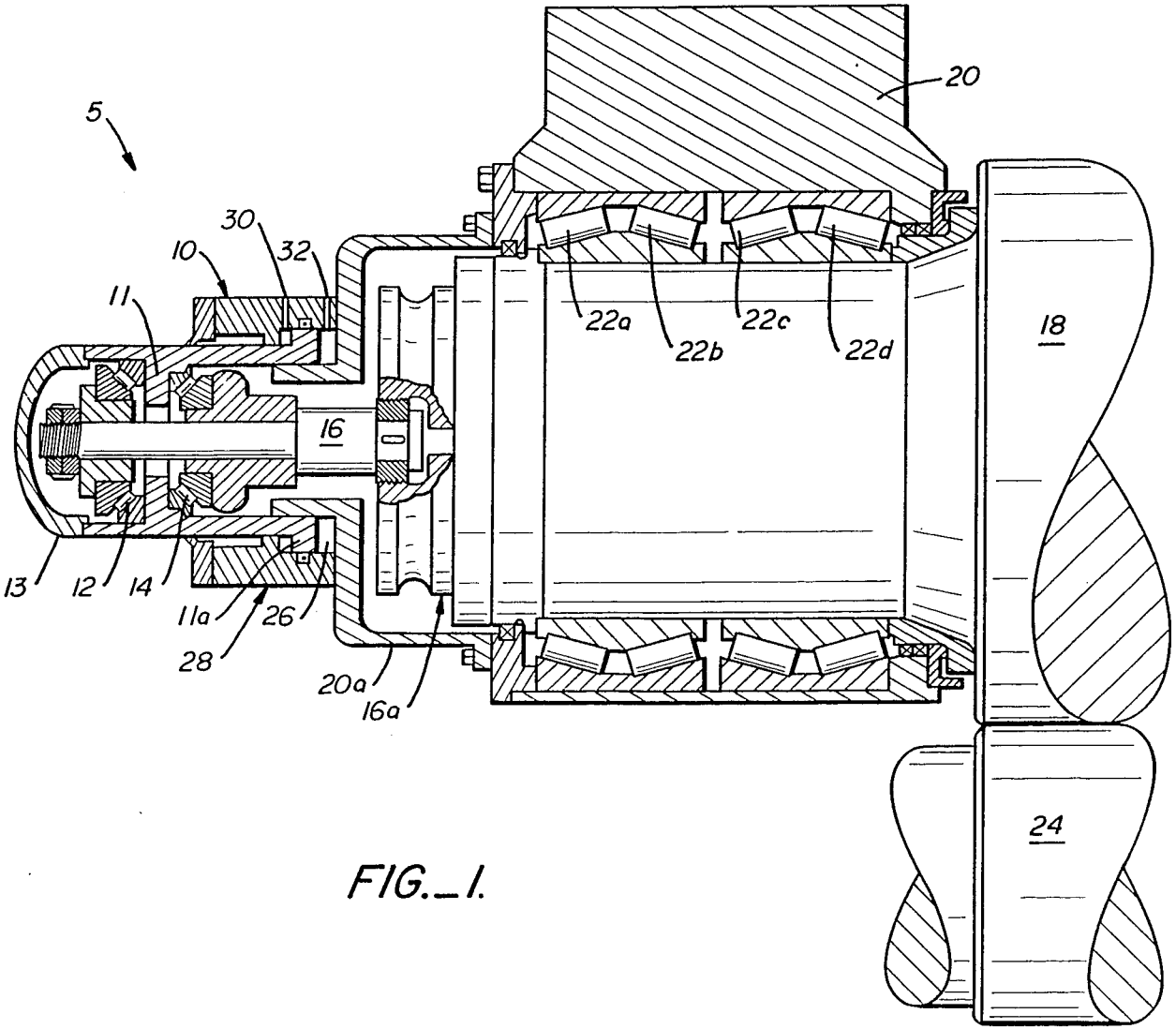
FIG. 1 is an enlarged cross-sectional view of part of portion of a 4-high rolling mill and illustrates actuator equipment for applying an axial thrust load to the neck of a backup roll.

With further reference to the drawings, and in particular FIG. 1, the axal thrust load applicators 5 generally comprise, in one preferred embodiment of the invention, a fluid ram or piston cylinder assembly 10. Since the opposing roll neck of the backup roll of FIG. 1 as well as the roll necks of the lower backup roll for the same 4-high mill, none of which is shown in FIG. 1, are all similarly mounted and provided with similar thrust actuators, a description of one will suffice for all. The stepped piston stem 11 of the assembly 10 is advantageously interposed between a pair of auxiliary or outside tapered roller bearing assemblies 12 and 14. Assemblies 12 and 14 along with assembly 10 are connected to the elongated extension 16 of the roll neck 16*a* of the backup roll 18 and roll 18 is mounted in the chock block assembly 20 by way of the further main or primary mill tapered roll bearings 22*a*, 22*b*, 22*c*, and 22*d*. The mill also includes the usual pair of work rolls 24, only one of which is shown. From the above, it will be observed that the piston and cylinder assembly 10 is located somewhat remote from the main tapered roller bearing assemblies 22*a*–22*d* and can include an end cover cap 13.

While the piston stem portion 11 of the assembly 10 is interposed between the secondary or auxiliary tapered roll bearing assemblies 12 and 14, fluid contacting piston head portion 11*a* is disposed in the chamber or fluid opening 26 of the cover appendage 28, suitably affixed to the chock block assembly 20 by way of a roll neck cap 20*a*. Opening 26 is provided with a pair of fluid ports 30 and 32 which lead to the usual sources of actuating fluid and valving mechanisms not shown in FIG. 1. These ports alternately introduce fluid into and exhaust fluid from chamber 26 so as to move piston elements 11 and 11*a* forward and backward and, in turn, exert thrust loads on the secondary bearing assemblies 12 and 14 initially and then through the main tapered bearings 22*a*–22*d* to the main body portion of roll 18.

It is a feature of rolling mill tapered bearing assemblies, when purely radial loads are applied to a series of rows of such assemblies, that the loading on each such row will be equal. However, if an axial thrust load is applied simultaneously to a plurality of such tapered bearing units along with the same radial loads, a transfer of loads will occur between the units because of their tapered construction, and only certain of the assemblies or units will resist the thrust loads. This, in turn, means that there will be a redistribution of the loads, and the loading per bearing unit or assembly will not remain uniform and, because of the redistribution of the radial loads, an offset in the total overall loads will be produced. This offset can then be advantageously used and vectored to produce a controlled deflection or bending of the roll neck provided with such bearing assemblies. Thus, in the present instance, such an offset can be effected by exertion of selected axial thrust loads initially on the auxiliary tapered roller bearing units 12 and 14 at the opposing roll necks and then upon the main bearings 22*a*–22*d* and the main body of the roll 18.

Further, since a backup roll 18, which bears against and supports a work roll 24, is of sufficient rigidity along the main body portion thereof or along the area of work roll support to minimize deflection in the same area or across the sheet width, the controlled deflection is applied in the area of least resistance or in the less rigid part of the backup roll, i.e., in the roll neck portion 16. Less wear is also produced on half of the various bearing assemblies for the roll 18, and bearing wear quality is promoted. The other half of the bearing assmblies will receive higher loading and more wear because of the externally applied thrust load provided by the instant development. Separating forces required to deform metal are substantial and are carried by the main tapered bearing assemblies, e.g., 22*a*–22*d* in the case of roll 18 and it is also characteristic.of a tapered roller bearing for a backup roll that the major loading of the same is radial. When the axial thrust load capability for deflection is provided by the instant development, the overall result is that the integrity of the rolling mill equipment can be maintained along with the basic radial load carrying properties of the tapered roll bearings, while at the same time providing for minute eccentricity compensating deflection of the backup roll 18 over a wide range of mill operating conditions. It is to be understood, of course, that the various axial thrust loads that can and are to be applied will ultimately be determined by individual mill tests, the particular tapered bearings used, and various operating conditions since each rolling mill has its own peculiar operating conditions.

Figure 2A:
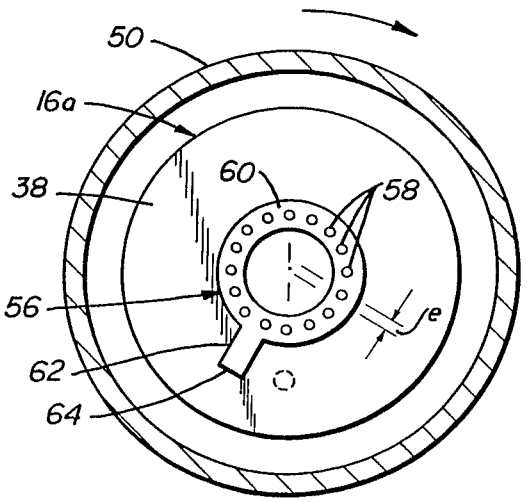
FIG. 2A is a view taken along line 2*a*—2*a* of FIG. 2 with parts removed.
Figure 2:
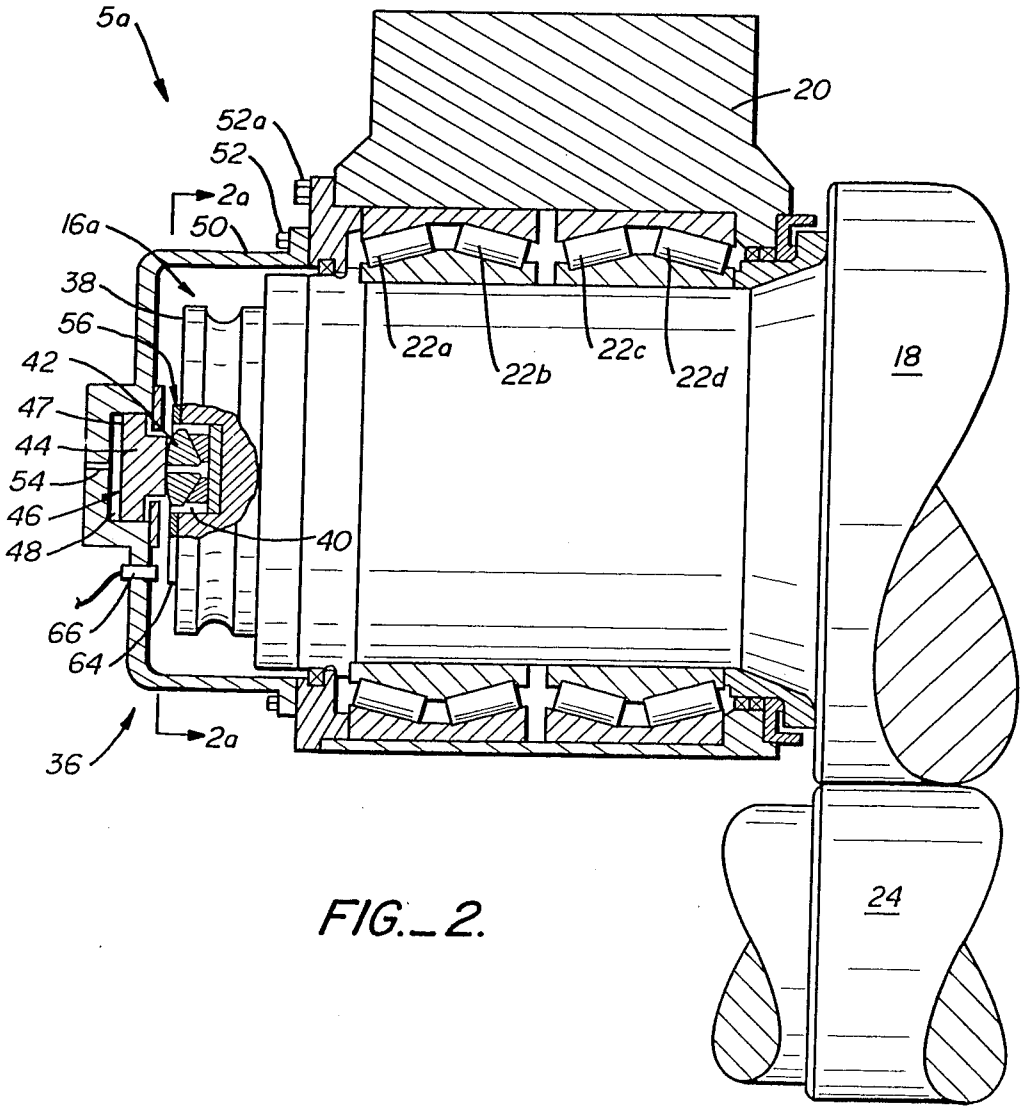
FIG. 2 is a view similar to FIG. 1 and illustrates a modified form of thrust load applicator.

In a further advantageous embodiment of the invention and as indicated in FIG. 2, another preferred axial thrust load applicator 5*a* for bending a backup roll selectively, such as backup roll 18 to compensate for backup roll eccentricity, comprises a single acting piston and cylinder assembly 36 integrated with the end 38 of the roll neck 16*a* of the backup roll 18. In this instance, it will be noted that the neck 16*a* does not have the extension 16 as in the case of the double acting thrust load actuator of FIG. 1. Instead, it includes an axial cavity or bore 40 in the end 38 of roll neck 16*a* for receiving a thrust bearing 42 suitably secured to the roll neck 16*a*. The stem end 44 of piston 46 is adapted to bear against the thrust bearing 42 at all times, with piston head 47 being mounted in the cylinder opening or chamber 48 of the roll neck cap 50 that is suitably affixed by bolts 52 and 52*a*, to the chock block assembly 20 of the roll neck 16*a*. It is also to be understood that just as in the case of the upper backup roll 18 of FIG. 1, the opposing neck end of roll 18 and the lower backup roll necks, none of which is shown in FIG. 2, are all provided with similarly arranged axial thrust load actuator assemblies 5*a*.

From the above, it will be noted that the thrust applicator 5a, because of its particular neck end location, can be said to be in close proximity to the main tapered bearings 22a–22d in contrast to the remote position of the assembly 10 of FIG. 1. The chamber 48 of the roll neck cap 50 is fitted with a single axial fluid port 54 for introducing and exhausting fluid from the chamber 48 to increase or relax pressure on the piston head 47 and, in turn, on axial thrust bearing 42 to produce the desired initial axial thrust loads on roll neck 16a of roll 18 to control the eccentricity of the said roll 18 from one direction. It is to be understood, of course, that the single-acting arrangement described in FIG. 2 has approximately one half the range of control that is possible with the arrangement as shown in FIG. 1.

In a further advantageous embodiment of the invention and with reference to FIGS. 2, 2a, 4 and 4a, an improved electro-mechanical control system for overall control of the various top and bottom backup rolls of a 4-high mill to compensate for backup roll eccentricity while using the axial thrust applicator of FIG. 2 will now be described. As noted previously, efforts to control backup roll eccentricity should preferably involve predicting when the eccentricity will cause a cyclic marking or imprinting of the metal being rolled and then applying a compensating operational signal to the axial thrust actuators at the proper time. All correctional signals are dependent upon the speed of response of the physical and/or electrical equipment, which makes the correction.

Figure 4:
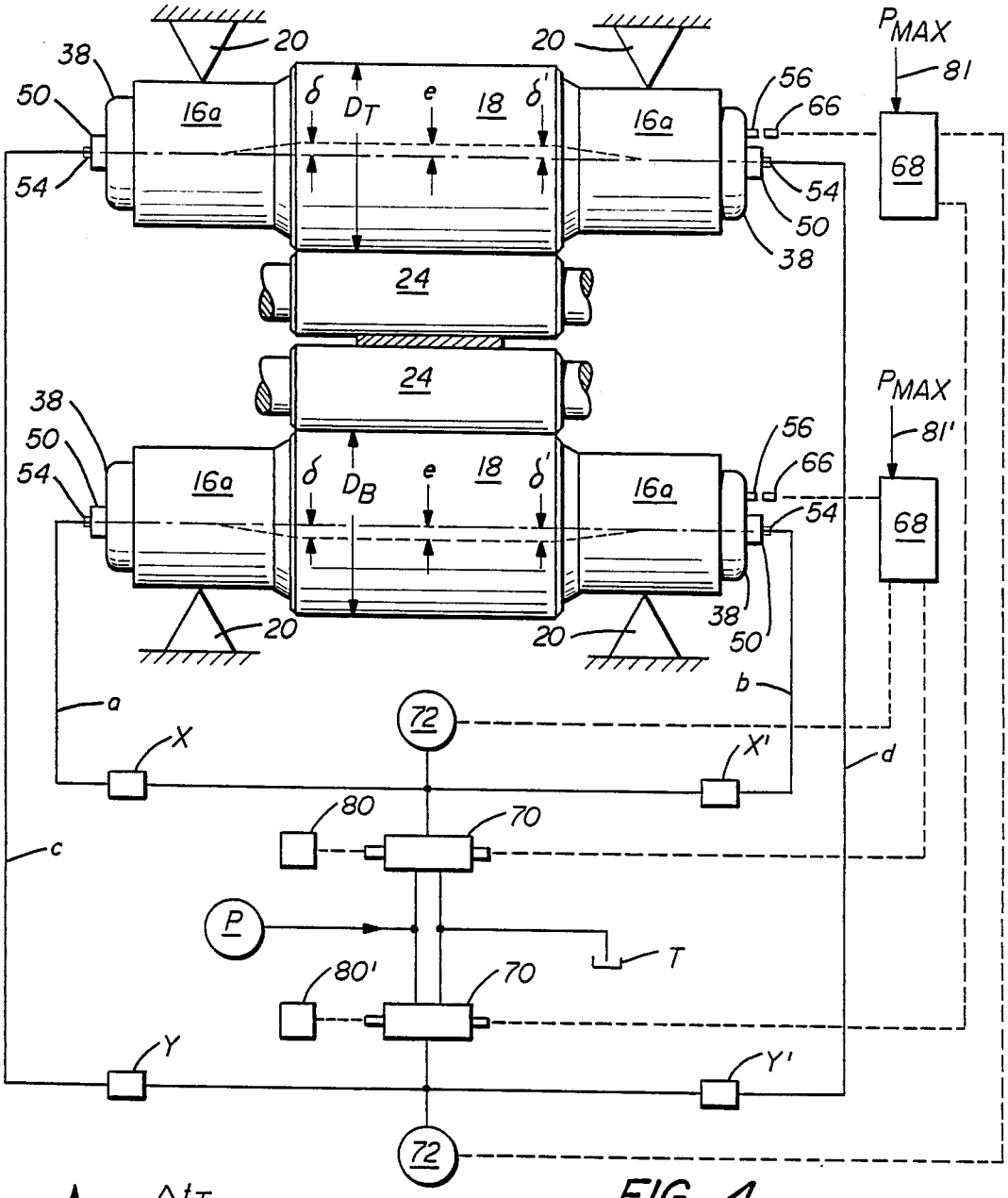
FIG. 4 is a diagramatic illustration of the essential parts of a rolling mill similar to that of FIG. 3 and illustrates a preferred fluid control circuit for controlling the eccentricity of a pair of backup rolls by applying selective thrust loads to the roll necks of the backup rolls by way of the thrust applicators of FIG. 2.

In an effort to satisfy these requirements, the system illustrated in FIG. 4 includes an eccentricity signaling device in the form of a striker element or plate 56 illustrated in detail in FIG. 2a. A striker plate 56 is adjustably mounted by the screw fasteners 58 at one of the ends 38 of each of the upper and lower backup roll necks 16a in the 4-high mill of FIG. 4. Each striker element 56 comprises an annular body 60 from which an arm 62 protrudes. After a given backup roll 18 to which the striker plate is to be attached is ground and its eccentricity or the angularity of its high point determined, the striker element 56 can then be adjustably affixed to the neck end 38 of this backup roll 18 in such a fashion that the tip 64 of the striker arm 62 will be radially arranged on the roll 18 to match the radial high point of the roll's eccentricity and if desired lead it rotationally by a slight amount. The gap change produced by the application of external thrust load is designated by S and S'.

When a pair of electrical finger probes 66, see FIG. 2, are also suitably attached to the same 4-high mill equipment as the striker plates 56, one for each striker plate, and properly disposed in the rotating path of travel of the striker plates 56, they can be made to send predetermined system triggering signals to appropriate electrical valve controllers 68 of a design and function well known in the art, there being one controller for each roll 18 and its probe 66. Each valve controller 68, in turn, controls a separate servo operated 4-way valve 70 and each valve 70 functions to selectively introduce predetermined amounts of hydraulic fluid supplied to the system by pump P and in the direction of the arrows of FIG. 4 to opposing roll neck ends of a given backup roll 18 and into the chambers 48 in the respective roll necks 16a of such roll. Only one cylinder port is used on valve 70; the other cylinder port of the 4-way valve is blocked. Thus, when a given striker plate 56 for a given roll 18 actuates a probe 66, the associated valve controller 68 and its 4-way valve will function to produce the proper eccentricity corrective deflection action on such roll 18. During this time, the 2-way valves x, x', y and y', the primary function of which is to be described hereinafter, are all left open in the system.

Also associated with each valve 70 and its valve controller 68 is a hydraulic pressure transducer 72 for feedback signal of a type well known in the art. The preset, 81, to the controller 68 is the maximum amount of fluid pressure ($p_{max}$) that the operator wants applied to the thrust producing pistons 46 of a given roll for forcing these pistons against their respective thrust bearings 42 to cause the required change in deflection or bending of a roll neck 18 to counter and compensate for the roll's eccentricity. Because of the presetting of each pressure transducer 72, if at any time the required amount of fluid pressure is lacking, the feedback signal of the transducer will automatically motivate its associated valve controller 68 to open its respective valve 70 further and increase the pressure to the amount needed so that the axial thrust force at the end of a given roll 18 will be adequate to correct roll eccentricity. The corresponding compensating or eccentricity correcting deflection of a backup roll 18 is shown in dotted lines in FIG. 4.

Inasmuch as the backup rolls for a given rolling mill are usually not identical diameters along their barrel lengths or main body portions, they will have different degrees of eccentricity as a result of grinding, and in any given mill will rotate at slightly different rates of speed. The combined effect of all these factors means a gauge deviation of the metal being rolled will occur with a repetitive beat. This is because part of the time the eccentricity of a first roll will be in a direction that will tend to cancel the eccentricity of the second roll, and part of the time the eccentricity of the first roll, will tend to augment or add to the eccentricity of the second roll. Accordingly, by correlating the individual applications of axial thrust loads as applied to the two backup rolls, say of FIG. 4A, with the actual rates of roll speeds as triggered by the signal from probe 66, the compensating deflection of the individual rolls can be graphically portrayed and matched to the actual phase of eccentricity disturbance for each roll. The valve controller 68 will drive the servo output pressure in sine wave fashion.

The resulting sine wave pattern will then be set up to depict the eccentricity relationships of a pair of backup rolls on the same mill. The aforesaid type of eccentricity correction will involve pressuring the cylinders 48 for the pistons 46 at the ends of the various backup rolls in the mill of FIG. 4 with a sine wave type pressure variation set at the frequency of the rotation of a particular roll such as $\Delta t_T$ for the upper roll 18 and $\Delta t_B$ for the bottom 18 with the diameter of the upper roll $D_T$, for example, being greater than the diameter of the bottom roll $D_B$. As set out above, because of this difference in roll diameters, the time taken for revolution of each of the rolls will be different with the smaller roller taking less revolution time. These factors will then all be correlated and used to advantage to provide eccentricity compensation for the actual phase difference ($\phi$) that is occurring due to the eccentricity. Normal mill shop grinding and dressing procedures, etc. involve measuring the total indicated runout of the rolls to determine if the necks need to be reground and thereby control roll eccentricity to the accuracy of the grinder. After the magnitude of the runout is obtained, the striker plate 56 for a given roll 18, as noted above, must be adjusted to denote the eccentric high point of such a roll and so as to allow the probe finger 66 for the same plate 56 to sense the angular orientation of the eccentricity in the mill at the end of the roll chock of the same roll. Upon the proper installation, the probe finger 66 can be disturbed and signal the angularity position and the high point of its associated roll 18 as the roll 18 goes into the roll gap so as to trigger its related valve controller 68.

Figure 4A:
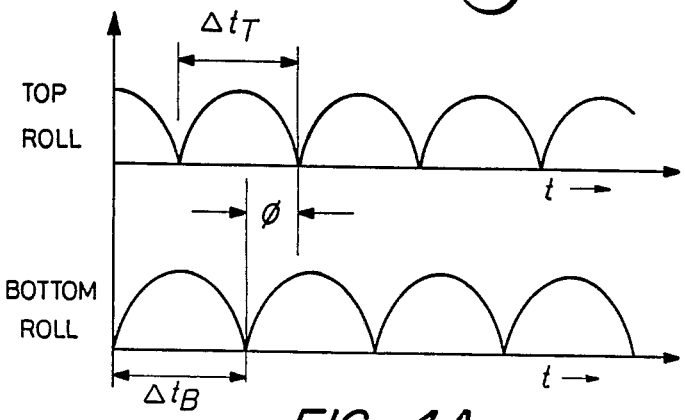
FIG. 4A is a graphic sine wave illustration of how the eccentricity control of one backup roll can be correlated with the same control as applied to a second backup roll in the same mill.

This same magnitude of runout is then correlated with the high point on the aforesaid given roll 18 and a presetting given to the pressure setpoint 81 which controls the ultimate peak pressure needed to effect the degree of deflection for the roll in question to compensate for its eccentricity. This pressure reference then becomes the final set point for a valve controller 68 connected to a particular pressure transducer 72, all of which ultimately control the flow of fluid and the pressurization of the axial thrust load actuators 5*a* for a given roll such as the upper backup roll 18 of FIG. 4. The same pressure setting procedure is followed as regards the lower backup roll 18. Thereafter, as illustrated in FIG. 4A, the valve controller 68 for the upper backup roll 18 will drive or actuate its associated 4-way valve 70 from zero pressure to the $p_{max}$ pressure setting in sine wave fashion at the frequency imposed by the trigger signal from the probe finger on the top backup roll assembly 18. At the same time, a similar action can be made to take place with respect to the deflection of the lower backup roll 18 which, because of its smaller relative diameter and faster relative rotation, will have a sine wave rotational showing that is different from and usually out of phase with the sine wave rotational showing of the larger upper roll 18 by way of the wave amplitude and frequency. The sine waves of the two rolls, because of their differences as noted, will only be infrequently in phase.

In a further advantageous embodiment of the invention and in the event it is desirable to also use the backup roll deflection control system of FIG. 4 to produce a selected sideways movement or steering of the metal material through a 4-high mill or the like, the invention contemplates that the fluid lines a and b for the lower backup roll 18 can be equipped with lefthand and right hand 2-way cutoff valves x and x' respectively while similar 2-way cutoff valves y and y' can be incorporated in the lines c and d respectively for the upper backup roll 18. In this arrangement, all that is necessary, for example, to effect a steering of the metal material to the left as viewed in FIG. 4 would be to selectively close the left hand valves x and y while leaving valves x' and y' open and then give a preselected slight tilt of the backup rolls 18 toward each other at the right hand side of the mill to produce a sheet gap profile such as is shown in FIG. 3*a*. At the same time, valves 70 could be providedwith separate valve controllers 80 and 80' of a well known design in the art for properly controlling valves 70 as well as suitable means for activating these valve controllers 80 and 80' directly by the mill operator while the valve controllers 68 and pressure transducers 72 are also placed in a deactivated state. The thrust pressure would then be held constant by the mill operator controlling valves 70 until the steering effect is no longer desired. If it is necessary to maintain gauge control at the same time as the steering is progressing, means well known in the art but not shown can be used to effect pivoting of the rolls, such as the work rolls about the center line of the mill. From the above description, it will be observed that the roll deflection system schematically shown in FIG. 4 can be used with slight modifications either to control roll eccentricity of the backup rolls or strip steering control.

Figure 5:
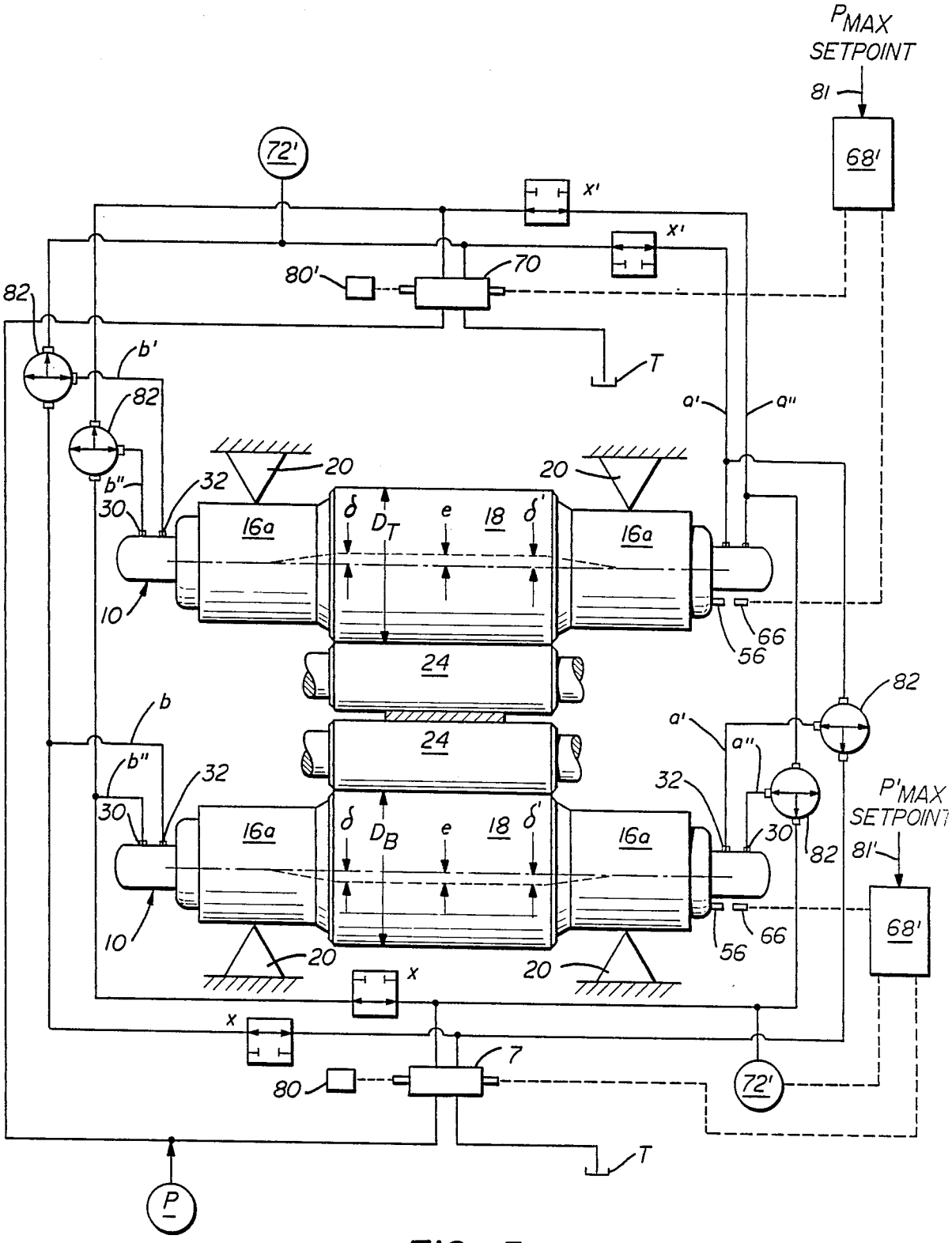
FIG. 5 is a diagramatic showing of another embodiment of a control system according to the instant invention.

FIG. 5 illustrates a still further advantageous embodiment of the instant invention wherein the double acting piston and cylinder assembly 10 of FIG. 1 can be employed to effect selective backup roll deflection and a compensation of backup roll eccentricity. The system of this particular embodiment of the invention, however, differs from the system of FIG. 3 while employing the piston and cylinder scheme of FIG. 1 in that separate 4-way servo valves are used for each backup roll 18 to obtain backup roll eccentricity compensation. The control system segment for each individual backup roll includes two sets of fluid lines a', b', a'' and b'' connected to 4-way servo operated valve 70. These fluid lines lead to opposite ends of the various double acting cylinder assemblies 10 that are integrated with the extended neck portions 16 of the top and bottom backup roll 18 shown in FIG. 1. The system of FIG. 5 also can include striker plates 56 and probe fingers 66 for activating valve controllers 68'. A pressure transducer 72' can be connected the lines a'' and b'' leading to what may be termed outside ports 30 for each end of each backup roll 18, and as with the case of the electro-mechanical system of FIG. 4, each transducer, because of its presetting as desired, provides a selected pressure feedback signal to the particular valve controller 68' with which it is associated. In this way the valve controllers 68' can be activated to increase the pressure on the upper and lower backup rolls through the respective pressure lines a'' and b'' and valves 70 for each backup roll to bring the axial thrust loads up to the desired values to produce a compensatory eccentricity deflection. The lines a' and b' are at zero pressure (tank pressure) under this type of control.

The valves x and x' working in conjunction with fluid selector valves 82 are shown in position for eccentricity correction for the operation just described. When x and x' are closed and selector valve 82 is rotated 90°, the control circuit is fashioned to permit steering control. This control requires the valves 70 to control the right side and left side independently, whereas the eccentricity control must control top and bottom roll independently. Here the separate valve controllers 80 and 81 function in a manner described for FIG. 4. As in FIG. 4 describing steering control the direction of thrust produced by 10 on the right side will be reversed on the left side.

One advantage to be found in using the control system of FIG. 5 with its unique double acting piston and cylinder assembly 10 of FIG. 1 in lieu of the assembly 36 of FIG. 2 is that of pressure selectivity, and the axial thrust loads applied produce increased control range over those of the system of FIG. 4 wherein singular pressure applicators are used.

Figure 3:
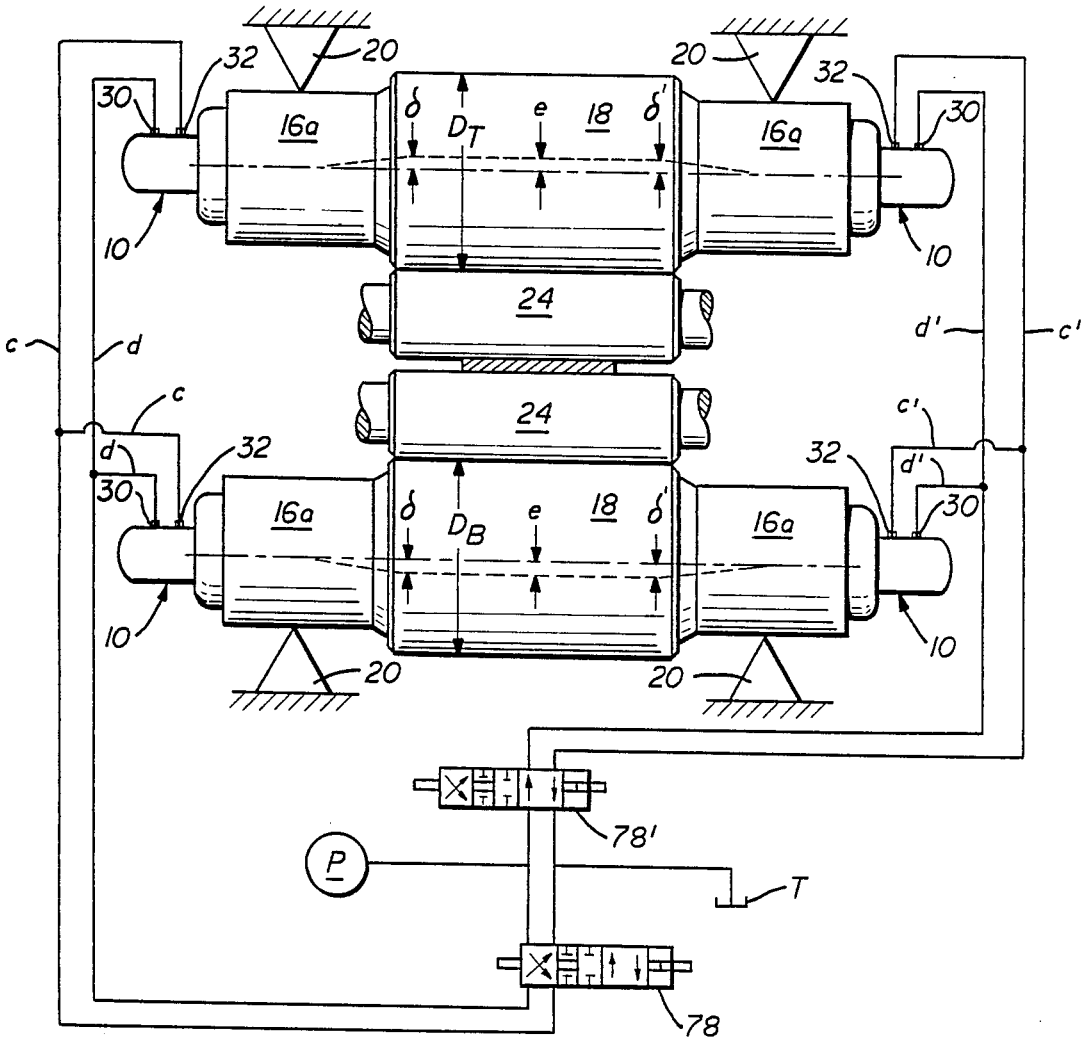
FIG. 3 is a diagramatic illustration of the essential parts of a 4-high rolling mill and shows how the thrust force applicators of FIG. 1 can be connected to the roll necks of a backup roll.
Figure 3A:
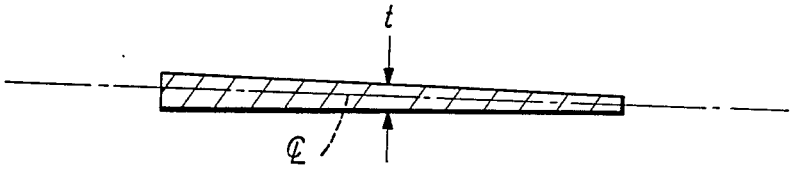
FIG. 3A is a cross-sectional view of material passing through the rolling mill of FIGS. 3 or 4, wherein the gap control as performed by the thrust applicators can be used to steer the material through the mill without necessarily correcting backup roll eccentricity.

In another advantageous embodiment of the invention and as shown in FIG. 3, the control system can be modified and employed to provide a steering control for the material passing through the mill. In this case, a separate solenoid operated 4-way valve 78' is used for controlling the pressure on the top and bottom backup rolls on a given side of the mill. The solenoid operated control valves 78' are activated directly by the mill operator to selectively connect these left and right hand valves with lines c and c' leading to ports 32 for the piston and cylinder assemblies 10 of the type shown in FIG. 1 and lines d and d′ leading to ports 30 for the same assemblies. In the system as shown the area difference between the rod end, e.g., the end nearest the port 30 and the blind end of the piston or the end nearest the port 32 would be accommodated in the hydraulic system design as would the difference in neck deflection depending on what direction the axial thrust force is to act. Thus, in the system as depicted in FIG. 3 the right side hand directional control valve 78′ is used to cause application of axial thrust loads to the left and a steering of the metal to the left side of the mill where the roll gap increases. At the same time, the left side directional control valve 78′ is operated in a reverse fashion to reverse the direction of the thrust on the left side side assemblies 10 aiding in the steering of the metal to the left side of the mill by increasing the gap on the left side. The additional gap produced on the left side of the strip is identical to the reduced gap on the right. When the system of FIG. 3 is used for steering rather than roll eccentricity control, the work rolls can be controlled, by devices and equipment well known in the art, to pivot about the center line of the mill whereby the average gauge of the metal material being processed would not materially change. Finally, it is to be understood that when it is desired to steer the metal material to the right, the operation of the left and right hand control valves 78′ is simply reversed from that just described.

Advantageous embodiments of the invention have been shown and described. It is obvious that various changes and modifications may be made therein without departing from the spirit and scope thereof as defined in the appended claims wherein:

What is claimed is:

1. A system for controlling the deflection of rolling mill backup rolls to compensate for backup roll eccentricity comprising the combination of:

(a) at least one backup roll;

(b) chock block means for mounting the backup roll in the stand of a rolling mill;

(c) tapered roller bearing means for mounting the backup roll in the chock block means;

(d) axial thrust load applicator means arranged in said mill stand and connected to a roll neck end of the backup roll for selectively deflecting the backup roll neck to compensate for the eccentricity of the backup roll that results from the grinding thereof; and (e) electro-mechanical means for selectively and automatically operating said axial thrust load applicator means upon a predetermined rotational orientation of the backup roll.

2. The system of claim 1 wherein the last mentioned means comprises a signal generating element adjustably affixed to the backup roll.

3. The system of claim 1 wherein the axial thrust load applicator means comprises a single acting piston and cylinder means connected to the axial end portion of the backup roll neck.

4. The system of claim 1 wherein the axial thrust load applicator means comprises a double acting piston and cylinder means affixed to an extension of the backup roll neck.

5. The system of claim 1 wherein the last mentioned means comprises a fluid pressure circuit means and a signal generating means carried by said backup roll for activating said fluid pressure circuit means and said axial thrust load applicator means.

6. The system of claim 4 wherein the double acting piston and cylinder means acts in conjunction with a further tapered rolling thrust bearing means affixed to the extension of the backup roll neck.

7. A system for controlling the deflection of rolling mill backup rolls to compensate for backup roll eccentricity produced during roll grinding comprising the combination of:

(a) a plurality of backup rolls;

(b) a separate axial thrust load applicator means connected to each neck end of a backup roll;

(c) separate tapered roller bearing means for mounting each roll neck end of a backup roll in the rolling mill stand; and (d) electro-mechanical means for selectively and automatically operating various axial thrust load applicator means upon predetermined rotational orientation of the backup rolls.

8. A system as set forth in claim 7 wherein said electro-mechanical means include fluid pressure circuit means connected to the various axial thrust load applicator means and triggering means for said circuit means actuatable by said backup rolls during the rotational movements thereof.

9. A system as set forth in claim 8 wherein said triggering means includes a striker element on a backup roll and an electrical probe element disposed in the path of travel of the striker element and valve means in said circuit means responsive to the signals generated by contact of the striker element with said probe element.

10. A system as set forth in claim 9 wherein the striker element is adjustably affixed to a backup roll so as to match the radial high poit of the backup roll's eccentricity.

* * * * *